US011268387B2

(12) United States Patent
Quach et al.

(10) Patent No.: US 11,268,387 B2
(45) Date of Patent: Mar. 8, 2022

(54) SPLAYED TIP FEATURES FOR GAS TURBINE ENGINE AIRFOIL

(71) Applicant: United Technologies Corporation, Farmington, CT (US)

(72) Inventors: San Quach, Southington, CT (US); Tracy A. Propheter-Hinckley, Rocky Hill, CT (US); Dominic J. Mongillo, Jr., West Hartford, CT (US); Steven Bruce Gautschi, Milton, MA (US)

(73) Assignee: Raytheon Technologies Corporation, Farmington, CT (US)

( * ) Notice: Subject to any disclaimer, the term of this patent is extended or adjusted under 35 U.S.C. 154(b) by 460 days.

(21) Appl. No.: 16/239,689

(22) Filed: Jan. 4, 2019

(65) Prior Publication Data

US 2020/0024957 A1 Jan. 23, 2020

Related U.S. Application Data

(63) Continuation of application No. 14/630,814, filed on Feb. 25, 2015, now Pat. No. 10,329,916.

(60) Provisional application No. 61/986,951, filed on May 1, 2014.

(51) Int. Cl.

| | |
|---|---|
| ***F01D 5/18*** | (2006.01) |
| ***F01D 5/14*** | (2006.01) |
| ***B22C 9/10*** | (2006.01) |
| ***F01D 5/28*** | (2006.01) |

(52) U.S. Cl.

CPC ..... *F01D 5/147* (2013.01); *B22C 9/103* (2013.01); *F01D 5/187* (2013.01); *F01D 5/284* (2013.01); *F05D 2230/21* (2013.01); *F05D 2240/304* (2013.01); *F05D 2240/307* (2013.01); *F05D 2260/2212* (2013.01); *F05D 2300/6033* (2013.01)

(58) Field of Classification Search

None

See application file for complete search history.

(56) References Cited

U.S. PATENT DOCUMENTS

| | | | | |
|---|---|---|---|---|
| 4,606,701 A * | 8/1986 | McClay | F01D 5/187 | 416/92 |
| 4,761,116 A * | 8/1988 | Braddy | F01D 5/187 | 415/115 |
| 4,992,025 A | 2/1991 | Stroud et al. | | |
| 5,261,789 A * | 11/1993 | Butts | F01D 5/186 | 416/96 R |
| 5,482,435 A | 1/1996 | Dorris et al. | | |
| 5,486,090 A | 1/1996 | Thompson et al. | | |
| 5,503,529 A * | 4/1996 | Anselmi | F01D 5/186 | 416/97 R |

(Continued)

FOREIGN PATENT DOCUMENTS

| | | |
|---|---|---|
| EP | 1443178 A2 | 8/2004 |
| EP | 1715139 A2 | 10/2006 |

(Continued)

*Primary Examiner* — Kayla Mccaffrey

(74) *Attorney, Agent, or Firm* — Bachman & LaPointe, P.C.

(57) ABSTRACT

A component for a gas turbine engine includes a trailing edge tip corner that at least partially defines a trailing edge cavity and a multiple of corner features within the trailing edge cavity, the multiple of corner features splayed along the trailing edge tip corner.

13 Claims, 12 Drawing Sheets

(56) References Cited

U.S. PATENT DOCUMENTS

| | | | | |
|---|---|---|---|---|
| 6,254,333 | B1 | 7/2001 | Merry | |
| 6,257,831 | B1 * | 7/2001 | Papple | B22C 9/10 416/97 R |
| 6,402,470 | B1 | 6/2002 | Kvasnak et al. | |
| 6,506,022 | B2 | 1/2003 | Bunker | |
| 6,824,359 | B2 * | 11/2004 | Chlus | F01D 5/187 416/92 |
| 7,118,342 | B2 | 10/2006 | Lee et al. | |
| 7,427,188 | B2 | 9/2008 | Neuhoff et al. | |
| 7,438,527 | B2 | 10/2008 | Albert et al. | |
| 7,673,669 | B2 | 3/2010 | Snyder et al. | |
| 7,757,745 | B2 | 7/2010 | Luczak | |
| 8,092,178 | B2 * | 1/2012 | Marini | F01D 5/20 416/97 R |
| 8,628,299 | B2 * | 1/2014 | Ammann | F01D 5/20 416/97 R |
| 8,920,111 | B2 | 12/2014 | Lee et al. | |
| 2003/0075300 | A1 | 4/2003 | Shah et al. | |
| 2005/0152785 | A1 | 7/2005 | McGrath et al. | |
| 2005/0281671 | A1 | 12/2005 | Liang | |
| 2007/0044934 | A1 | 3/2007 | Santeler | |
| 2008/0131285 | A1 | 6/2008 | Albert et al. | |
| 2008/0181774 | A1 | 7/2008 | Cunha | |
| 2008/0226462 | A1 | 9/2008 | Albert et al. | |
| 2011/0020115 | A1 | 1/2011 | Hudson | |
| 2013/0092340 | A1 | 4/2013 | Dube et al. | |
| 2013/0111751 | A1 | 5/2013 | Hudson | |
| 2013/0177446 | A1 | 7/2013 | Smith et al. | |
| 2014/0147287 | A1 | 5/2014 | Xu | |

FOREIGN PATENT DOCUMENTS

| | | | |
|---|---|---|---|
| EP | 1939400 | A2 | 7/2008 |
| EP | 2204248 | A1 | 7/2010 |
| EP | 2213838 | A2 | 8/2010 |
| EP | 2286938 | A2 | 2/2011 |
| WO | 2011/050025 | A2 | 4/2011 |

* cited by examiner

SPLAYED TIP FEATURES FOR GAS TURBINE ENGINE AIRFOIL

CROSS REFERENCE TO RELATED APPLICATION

The instant application is a continuation application of U.S. patent application Ser. No. 14/630,814 filed Feb. 25, 2015, which claims the benefit of provisional application Ser. No. 61/986,951, filed May 1, 2014.

STATEMENT REGARDING FEDERALLY SPONSORED RESEARCH OR DEVELOPMENT

This disclosure was made with Government support under N00019-12-D-0002-4Y01 awarded by The United States Navy. The Government has certain rights in this disclosure.

BACKGROUND

The present disclosure relates to components for a gas turbine engine and, more particularly, to cooling features within an airfoil therefor.

Gas turbine engines typically include a compressor section to pressurize airflow, a combustor section to burn a hydrocarbon fuel in the presence of the pressurized air, and a turbine section to extract energy from the resultant combustion gases. Gas path components, such as turbine blades, often include airfoil cooling that may be accomplished by external film cooling, internal air impingement and forced convection either separately or in combination. In forced convection cooling, compressor bleed air flows through internal cavities of hot section blades and vanes to continuously remove thermal energy. Compressor bleed air enters the internal cavities through one or more inlets to the internal cavities, which then discharge though various exits. The internal cavities often communicate with a trailing edge cavity that directs cooling air around an internal pedestal array to axially exit through a trailing edge passage of the blade. Although effective, trailing edge tip corner burning/creep is common in turbine blades.

Advances in casting, such as refractory metal core (RMC) technology, facilitate significantly smaller and more complex passages to accommodate the elevated temperatures with a reduced flow of cooling air. Refractory metal cores are metal based casting cores usually composed of molybdenum with a protective coating. The refractory metal provides more ductility than conventional ceramic core materials while the coating (usually metallic) protects the base metal form alloying with the refractory metal in the investment casting process. RMCs have shown significant promise in casting feature sizes and geometries not attainable with ceramic cores alone.

SUMMARY

A component for a gas turbine engine according to one disclosed non-limiting embodiment of the present disclosure includes a trailing edge tip corner that at least partially defines a trailing edge cavity and a multiple of corner features within the trailing edge cavity, the multiple of corner features splayed along the trailing edge tip corner.

A further embodiment of the present disclosure includes, wherein the trailing edge tip corner is defined by a turbine blade.

A further embodiment of any of the foregoing embodiments of the present disclosure includes, wherein the multiple of corner features extend between a first and a second sidewall.

A further embodiment of any of the foregoing embodiments of the present disclosure includes, wherein the multiple of corner features extend between a suction side and a pressure side of a turbine blade.

A further embodiment of any of the foregoing embodiments of the present disclosure includes, wherein at least one of the multiple of corner features is of an oblong shape.

A further embodiment of any of the foregoing embodiments of the present disclosure includes, wherein at least one of the multiple of corner features is of a teardrop shape.

A further embodiment of any of the foregoing embodiments of the present disclosure includes, wherein the multiple of corner features defines a respective multiple of constant area channels.

A further embodiment of any of the foregoing embodiments of the present disclosure includes, wherein the multiple of corner features defines a respective multiple of divergent channels.

A further embodiment of any of the foregoing embodiments of the present disclosure includes, wherein the multiple of corner features defines a respective multiple of convergent channels.

A further embodiment of any of the foregoing embodiments of the present disclosure includes, wherein the multiple of corner features are recessed from an outer tip surface and an outer trailing edge surface of the trailing edge tip corner.

A further embodiment of any of the foregoing embodiments of the present disclosure includes, wherein the multiple of corner features define a respective multiple of channels each with an exit, each the exit recessed within a trench formed in the trailing edge tip corner.

A further embodiment of any of the foregoing embodiments of the present disclosure includes, wherein the trench is angled with respect to an outer tip surface of the trailing edge tip corner.

A further embodiment of any of the foregoing embodiments of the present disclosure includes, wherein the multiple of corner features includes an inner row and an outer row of features, the inner row and the outer row of features are each of a teardrop shape with a larger end of the inner row and the outer row of features face each other.

A component for a gas turbine engine according to another disclosed non-limiting embodiment of the present disclosure includes a first sidewall; a second sidewall that meets the first sidewall at a trailing edge; a tip between the first sidewall and the second sidewall to define a trailing edge cavity bounded by the tip and the trailing edge; and a multiple of features within the trailing edge cavity, the multiple of features including a multiple of trailing edge features adjacent to the trailing edge, a multiple of tip features adjacent the tip, and a multiple of corner features splayed between the trailing edge features and the tip features.

A further embodiment of any of the foregoing embodiments of the present disclosure includes, wherein the multiple of corner features define a respective multiple of channels each with an exit, each the exit recessed within a trench formed in the tip and the trailing edge.

A further embodiment of any of the foregoing embodiments of the present disclosure includes, wherein the trench is angled with respect to an outer tip surface of the tip.

A further embodiment of any of the foregoing embodiments of the present disclosure includes, wherein the tip and the trailing edge form a trailing edge tip corner of a turbine blade.

A core for an airfoil component according to another disclosed non-limiting embodiment of the present disclosure includes a ceramic core that forms a feed passage and a Refractory Metal Core (RMC) mounted to the ceramic core, the RMC includes a multiple of trailing edge apertures to form a multiple of trailing edge features, a multiple of tip apertures to from a multiple of tip features adjacent, and a multiple of corner apertures to form a multiple of corner features splayed between the multiple of trailing edge apertures and the multiple of tip apertures.

A further embodiment of any of the foregoing embodiments of the present disclosure includes, wherein the RMC includes a bend positioned along a corner thereof to arrange an RMC trailing edge to be in-line with a trailing edge of the airfoil component and a forward portion of the corner of the RMC 400 at an angle with respect to an outer tip surface of the airfoil component.

A further embodiment of any of the foregoing embodiments of the present disclosure includes, wherein the forward portion is angled at an angle $\alpha$ of about 10 degrees from a vertical plane that contains the RMC and at an angle $\beta$ of about 15-20 degrees from a plane normal to the RMC 400.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
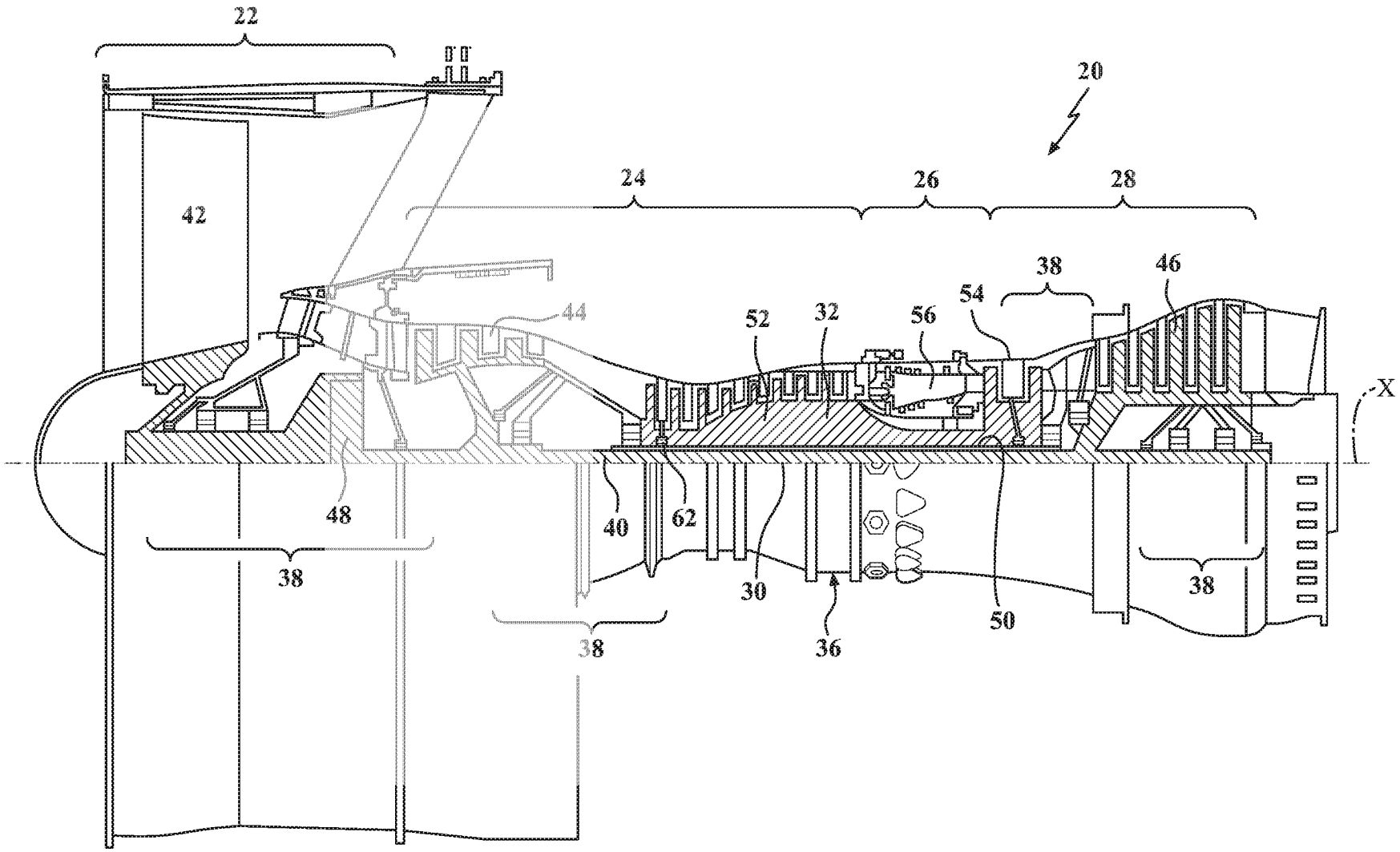
FIG. 1 is a schematic cross-section of an example gas turbine engine architecture.
Figure 2:
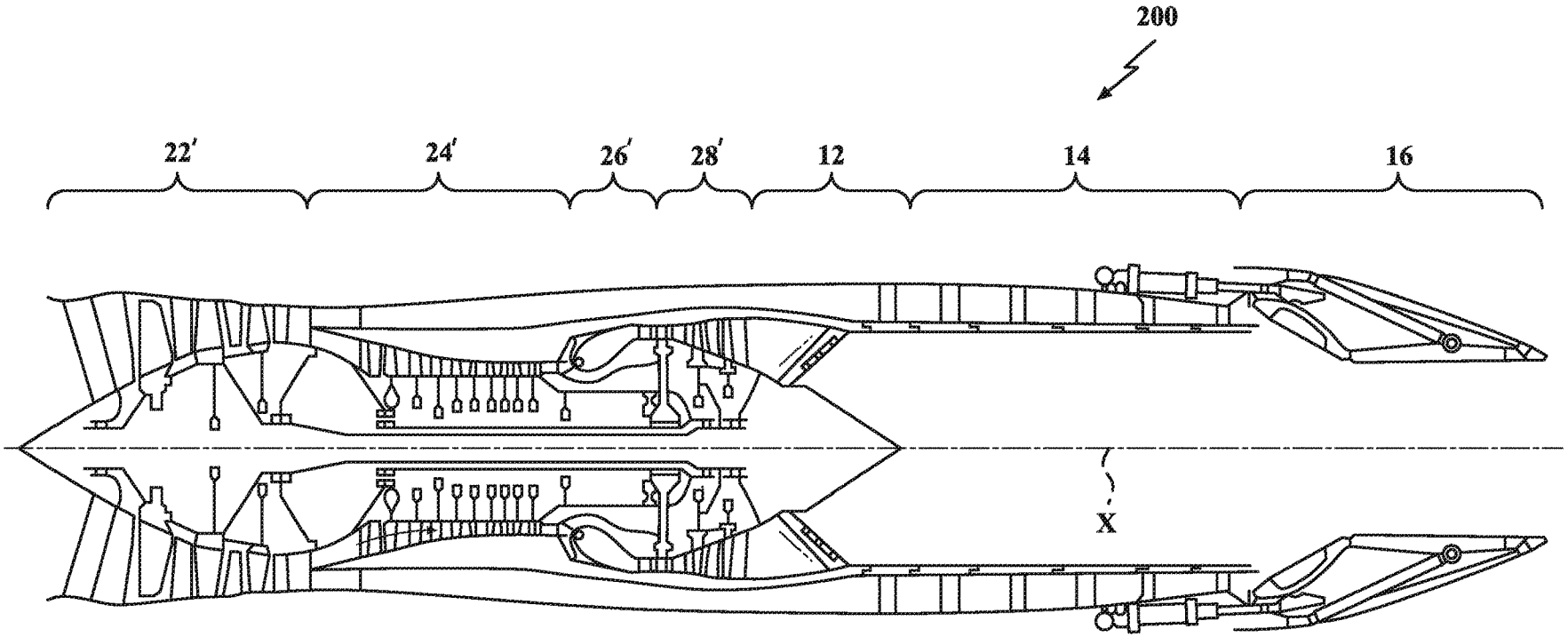
FIG. 2 is a schematic cross-section of another example gas turbine engine architecture.

FIG. 1 schematically illustrates a gas turbine engine 20. The gas turbine engine 20 is disclosed herein as a two-spool turbo fan that generally incorporates a fan section 22, a compressor section 24, a combustor section 26 and a turbine section 28. Alternative engine architectures 200 might include an augmentor section 12, an exhaust duct section 14 and a nozzle section 16 (FIG. 2) among other systems or features. The fan section 22 drives air along a bypass flowpath while the compressor section 24 drives air along a core flowpath for compression and communication into the combustor section 26 then expansion through the turbine section 28. Although depicted as a turbofan in the disclosed non-limiting embodiment, it should be understood that the concepts described herein are not limited to use with turbofans as the teachings may be applied to other types of turbine engine architectures such as turbojets, turboshafts, and three-spool (plus fan) turbofans.

The engine 20 generally includes a low spool 30 and a high spool 32 mounted for rotation about an engine central longitudinal axis X relative to an engine static structure 36 via several bearing structures 38. The low spool 30 generally includes an inner shaft 40 that interconnects a fan 42, a low pressure compressor ("LPC") 44 and a low pressure turbine ("LPT") 46. The inner shaft 40 drives the fan 42 directly or through a geared architecture 48 to drive the fan 42 at a lower speed than the low spool 30. An exemplary reduction transmission is an epicyclic transmission, namely a planetary or star gear system.

The high spool 32 includes an outer shaft 50 that interconnects a high pressure compressor ("HPC") 52 and high pressure turbine ("HPT") 54. A combustor 56 is arranged between the high pressure compressor 52 and the high pressure turbine 54. The inner shaft 40 and the outer shaft 50 are concentric and rotate about the engine central longitudinal axis X which is collinear with their longitudinal axes.

Core airflow is compressed by the LPC 44 then the HPC 52, mixed with the fuel and burned in the combustor 56, then expanded over the HPT 54 and the LPT 46. The turbines 54, 46 rotationally drive the respective low spool 30 and high spool 32 in response to the expansion. The main engine shafts 40, 50 are supported at a plurality of points by bearing structures 38 within the static structure 36. It should be understood that various bearing structures 38 at various locations may alternatively or additionally be provided.

Figure 3:
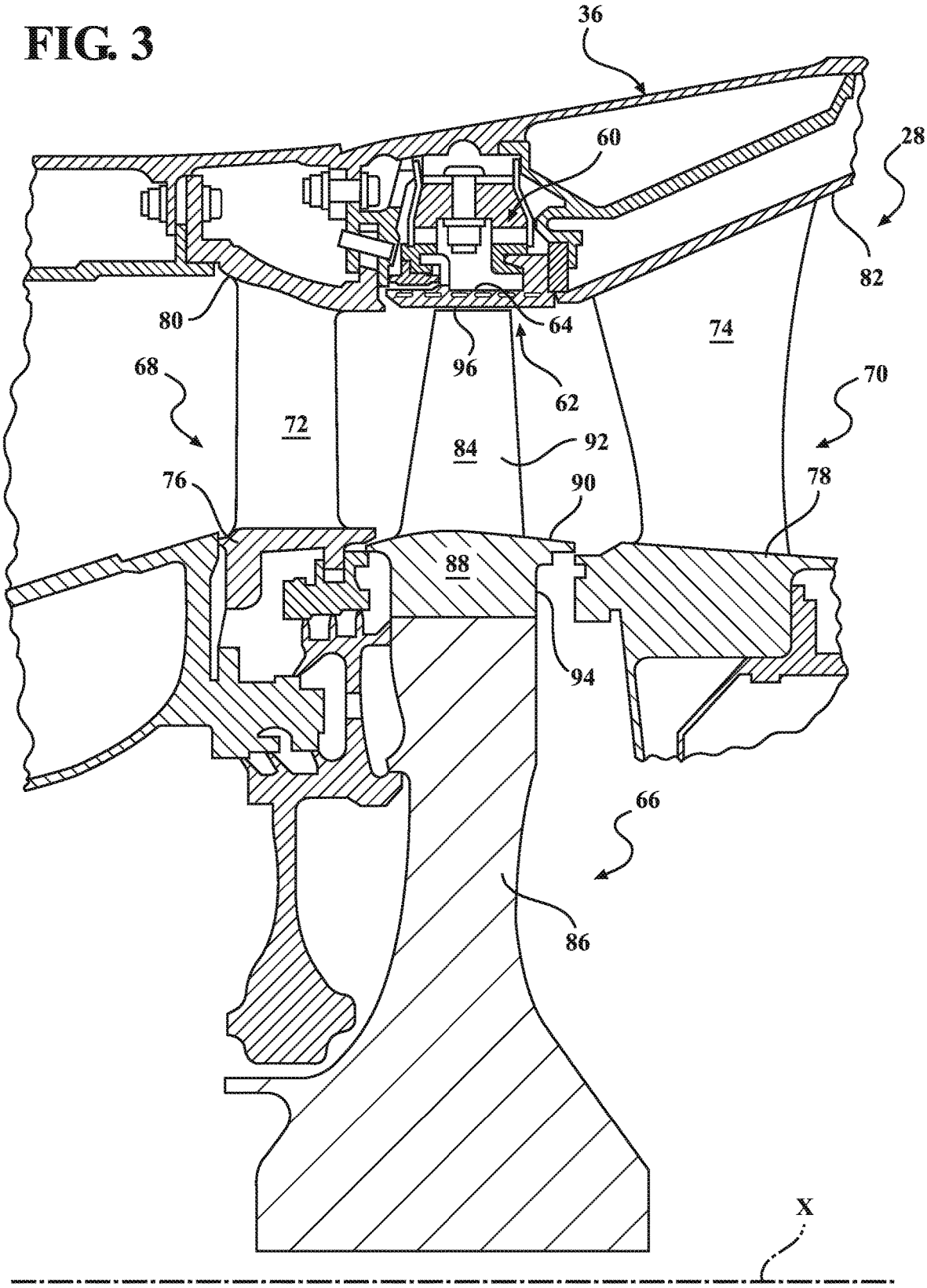
FIG. 3 is an enlarged schematic cross-section of an engine turbine section.

With reference to FIG. 3, an enlarged schematic view of a portion of the turbine section 28 is shown by way of example; however, other engine sections will also benefit herefrom. A full ring shroud assembly 60 within the engine case structure 36 supports a blade outer air seal (BOAS) assembly 62 with a multiple of circumferentially distributed BOAS 64 proximate to a rotor assembly 66 (one schematically shown).

The full ring shroud assembly 60 and the BOAS assembly 62 are axially disposed between a forward stationary vane ring 68 and an aft stationary vane ring 70. Each vane ring 68, 70 includes an array of vanes 72, 74 that extend between a respective inner vane platform 76, 78 and an outer vane platform 80, 82. The outer vane platforms 80, 82 are attached to the engine case structure 36.

The rotor assembly 66 includes an array of blades 84 circumferentially disposed around a disk 86. Each blade 84 includes a root 88, a platform 90 and an airfoil 92 (also shown in FIG. 4). The blade roots 88 are received within a rim 94 of the disk 86 and the airfoils 92 extend radially outward such that a tip 96 of each airfoil 92 is closest to the blade outer air seal (BOAS) assembly 62. The platform 90 separates a gas path side inclusive of the airfoil 92 and a non-gas path side inclusive of the root 88.

Figure 4:
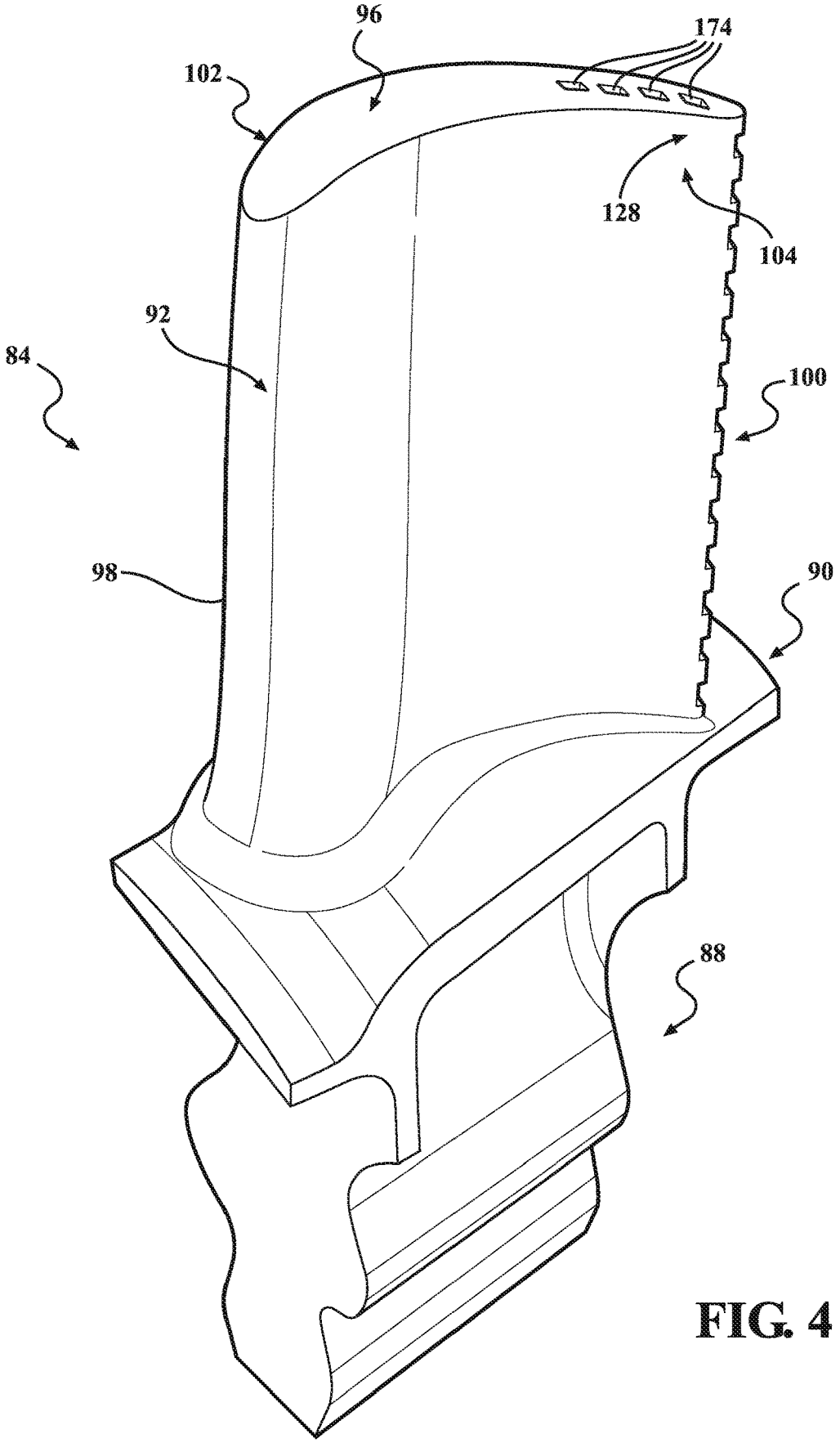
FIG. 4 is a perspective view of an airfoil as an example component with a trailing edge cavity.

With reference to FIG. 4, the platform 90 generally separates the root 88 and the airfoil 92 to define an inner boundary of a gas path. The airfoil 92 defines a blade chord between a leading edge 98, which may include various forward and/or aft sweep configurations, and a trailing edge 100. A first sidewall 102 that may be convex to define a suction side, and a second sidewall 104 that may be concave to define a pressure side are joined at the leading edge 98 and at the axially spaced trailing edge 100. The tip 96 extends between the sidewalls 102, 104 opposite the platform 90. It should be appreciated that the tip 96 may include a recessed portion.

Figure 5:
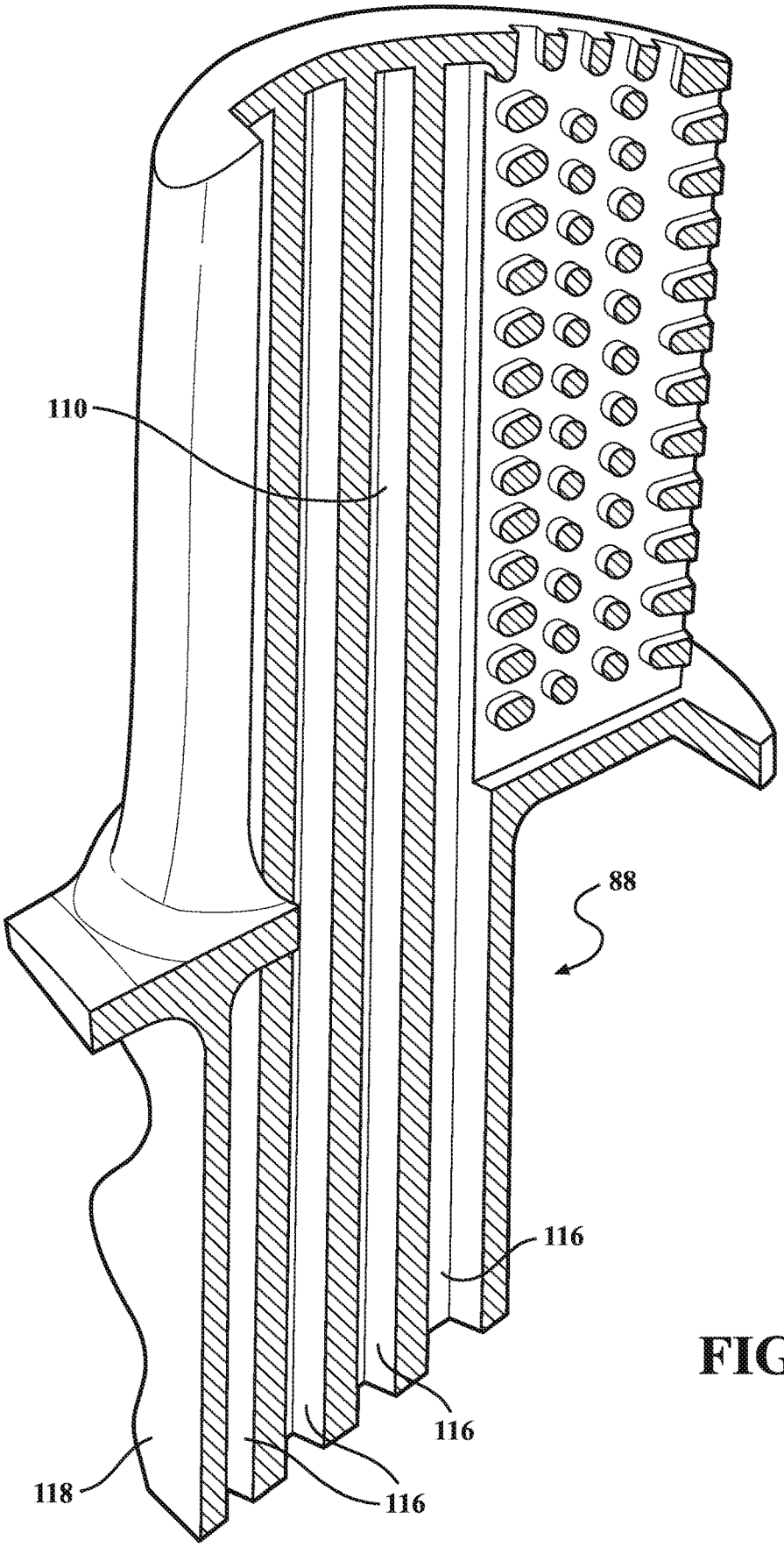
FIG. 5 is a schematic cross-section view of the airfoil of FIG. 4 showing the internal architecture.

To resist the high temperature stress environment in the gas path of a turbine engine, each blade 84 may be formed by casting. It should be appreciated that although a blade 84 with an array of internal passageways 110 (shown schematically; FIG. 5) will be described and illustrated in detail, other hot section components including, but not limited to, vanes, turbine shrouds, end walls and other components with a corner will also benefit from the teachings herein.

Figure 6:
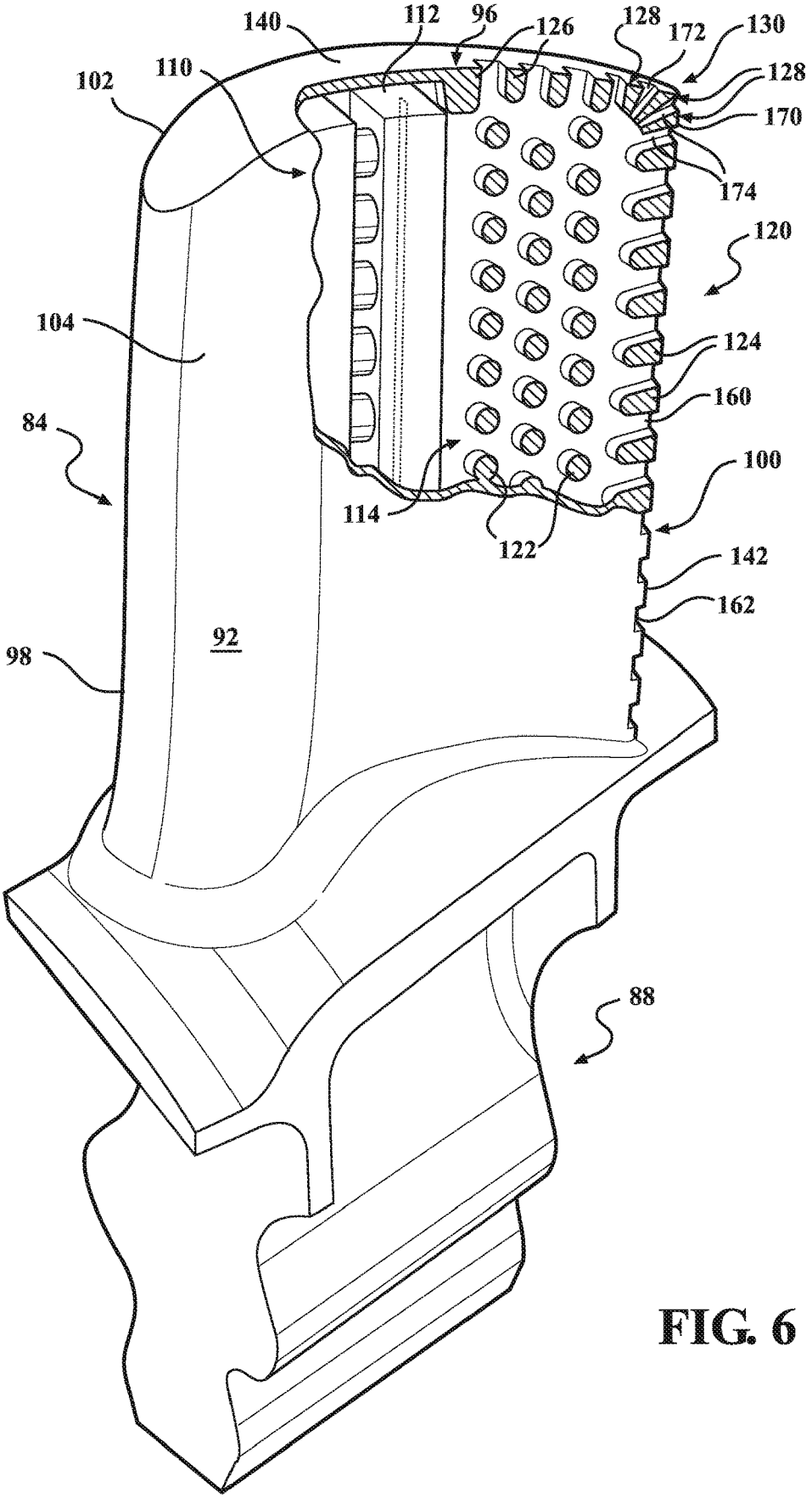
FIG. 6 is a schematic partial fragmentary view of a trailing edge cavity with a multiple of corner features according to one disclosed non-limiting embodiment.

With reference to FIG. 6, the array of internal passageways 110 includes a feed passage 112 that communicates airflow into a trailing edge cavity 114 within the airfoil 84. It should be appreciated that the array of internal passageways 110 may be of various geometries, numbers and configurations and the feed passage 112 in this embodiment is the aft most passage that communicates cooling air to the trailing edge cavity 114. The feed passage 112 generally receives cooling flow through at least one inlet 116 within the base 118 of the root 88 (FIG. 5). It should be appreciated that various feed architectures; cavities and passageway arrangements will benefit herefrom.

The tip 96 and the trailing edge 100 bound the trailing edge cavity 114 between the sidewalls 102, 104. The trailing edge cavity 114 includes a multiple of trailing edge cavity features 120. The features 120 in this disclosed non-limiting embodiment generally include a multiple of pedestals 122 that extend between the sidewalls 102, 104, a multiple of trailing edge features 124 that are arranged generally along the trailing edge 100, a multiple of tip features 126 that are arranged generally along the tip 96, and a multiple of corner features 128 that are arranged generally between the trailing edge features 124 and the tip features 126 adjacent to a trailing edge tip corner 130 of the airfoil 92. It should be appreciated that although particular features are delineated within certain general areas, the features may be otherwise arranged or intermingled and still not depart from the disclosure herein.

The pedestals 122 may be staggered and be of one or more shapes such as circular, rectilinear, diamond and others. The pedestals 122 generate turbulence in the cooling air flow and hence advantageously increases heat pick-up.

The trailing edge features 124 form a multiple of respective trailing edge feature channels 160 therebetween. The trailing edge features 124 extend to the trailing edge 100. The trailing edge features channels 160 thereby define trailing edge exits 162 through the trailing edge 100 such that the trailing edge 100 may be essentially discontinuous.

The corner features 128 are splayed between the trailing edge features 124 and the tip features 126 adjacent to the trailing edge tip corner 130. In other words, the corner features 128 are fanned between the trailing edge features 124 and the tip features 126. In one example, the corner features 128 may be spaced by about 30-90 degrees. That is, the splaying takes place over about 90 degrees and in one disclosed non-limiting embodiment, there are 3-10 corner features 128; hence the 30-90 degrees. The diffusion angle may be about 3-4 degrees which accounts for about 0.001" (0.0254 mm) of metallic coating, while diffusion and convergence angles are between about +/−7-10 degrees and more particularly about +/−9 degrees.

In this disclosed non-limiting embodiment, the corner features 128 are generally at least of a partially oblong shape 170 to form a multiple of respective corner feature channels 172 therebetween. Although an oblong shape 170 is illustrated in this disclosed non-limiting embodiment, it should be appreciated that various shapes will benefit herefrom. The corner feature channels 172 can be generally constant in meter to provide full cooling airflow coverage for the trailing edge tip corner 130 of the airfoil 92. Constant area channels, for example, facilitate high Mach number ejection of cooling air from the trailing edge tip corner 130 of the airfoil 92.

The corner features 128 in this disclosed non-limiting embodiment extend to an outer tip surface 140 of the tip 96 and an outer trailing edge surface 142 of the trailing edge 100. The corner feature channels 172 thereby define discrete corner feature channel exits 174 (also shown in FIG. 4) through the outer tip surface 140 and the outer trailing edge surface 142. That is, discrete exits 174 are provided in the edge surfaces 140, 142.

Figure 7:
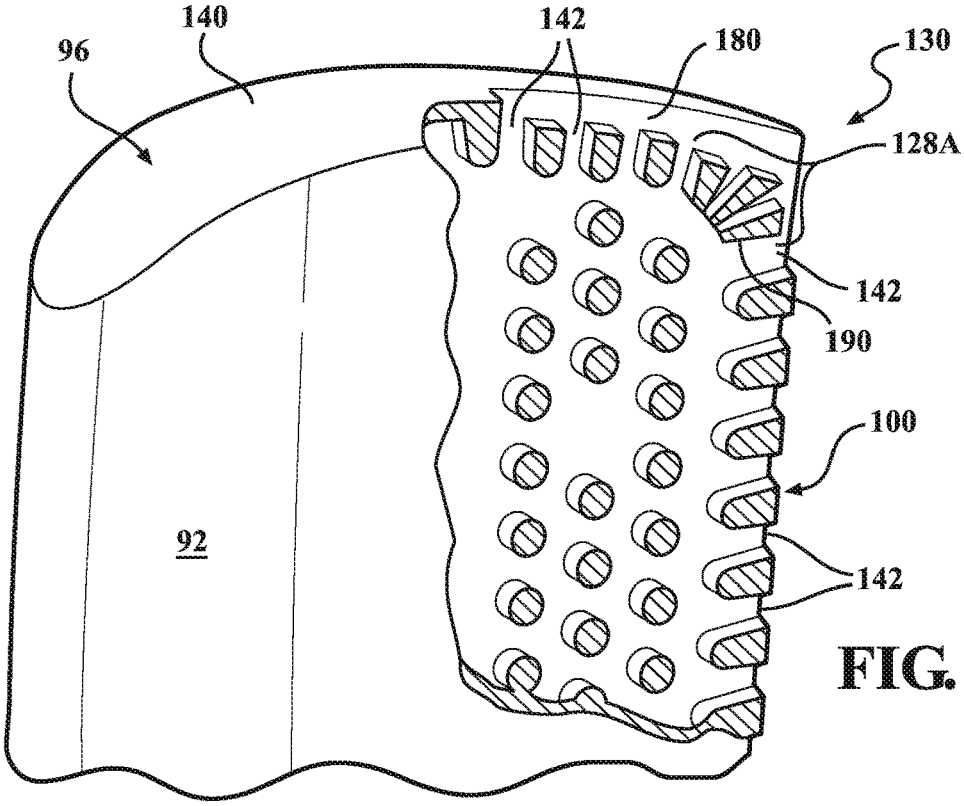
FIG. 7 is a schematic partial fragmentary view of a trailing edge cavity with a multiple of corner features according to another disclosed non-limiting embodiment.
Figure 8:
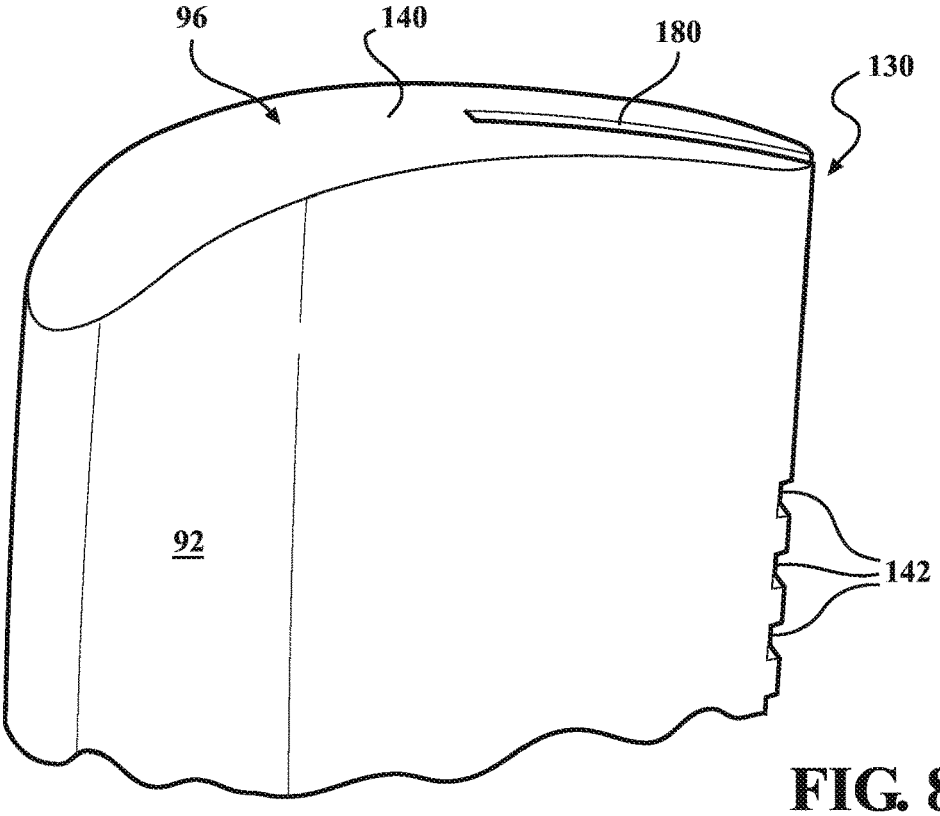
FIG. 8 is a schematic view of trailing edge of an airfoil according to one disclosed non-limiting embodiment.

With reference to FIG. 7, in another disclosed non-limiting embodiment, the corner features 128A are displaced from the outer tip surface 140 of the tip 96 and the outer trailing edge surface 142 of the trailing edge 100 to form a trench 180 (FIG. 8). That is, the trench 180 is essentially a slot that displaces the discrete exits 174 from the surfaces 140, 142 around the trailing edge tip corner 130 of the airfoil 92. That is, the discrete exits 174 are within the trench 180.

In one example, the corner features 128 are displaced by about 10-50 mils (0.254-1.27 mm) from the respective outer tip surface 140 and the outer trailing edge surface 142 to form the trench 180 to accommodate core shift and other tolerances. The trench 180 in this example is about 20 mils (0.508 mm) deep. The trench 180 facilitates airflow therethrough irrespective of the outer tip surface 140 interaction with the blade outer air seal (BOAS) assembly 62.

Figure 9:
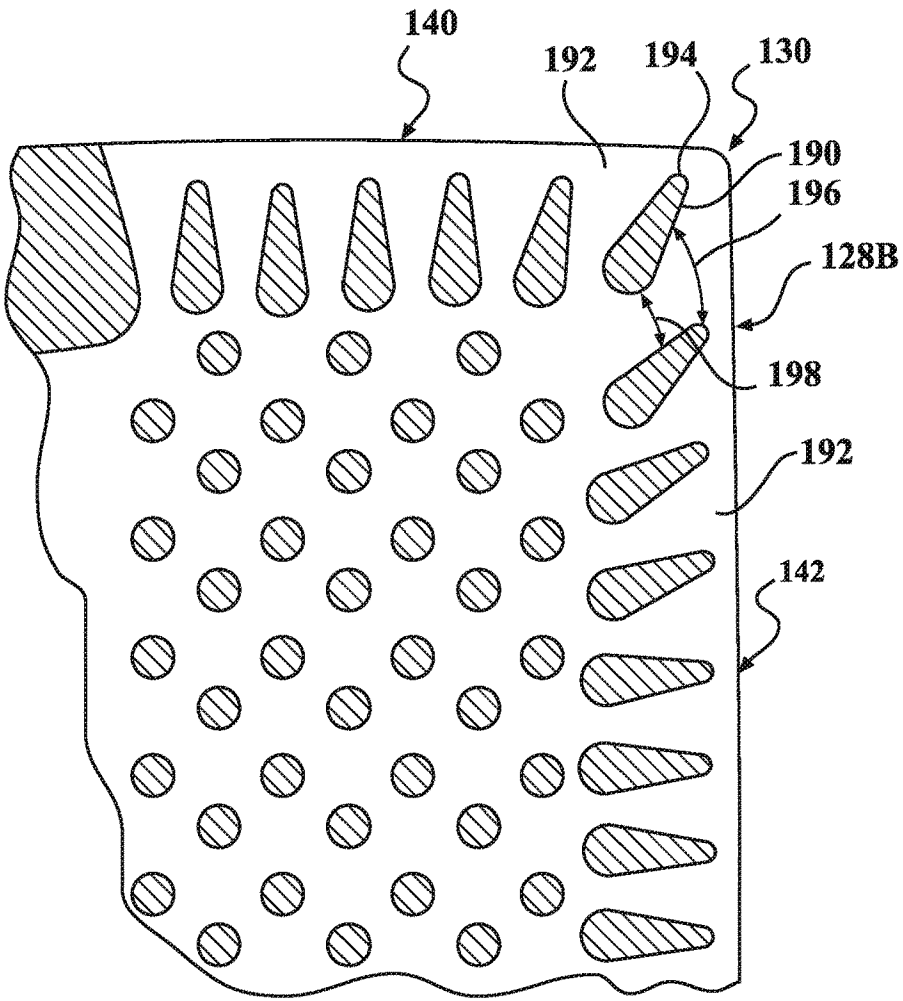
FIG. 9 is an expanded sectional view of a trailing edge cavity with a multiple of corner features according to another disclosed non-limiting embodiment.

With reference to FIG. 9, in another disclosed non-limiting embodiment, the corner features 128B are generally of a teardrop shape 190 to form a multiple of respective corner feature channels 192 therebetween to provide full cooling airflow coverage for the trailing edge tip corner 130 of the airfoil 92. Although the teardrop shape 190 is illustrated in this disclosed non-limiting embodiment, it should be appreciated that various shapes will benefit herefrom. Further, the teardrop shape 190 is shown here as displaced as discussed above to form the trench 180.

A smaller end 194 of the teardrop shape 190 are directed toward the outer tip surface 140 of the tip 96 and the outer trailing edge surface 142 of the trailing edge 100 such that the respective corner feature channels 192 in this disclosed non-limiting embodiment provides divergent channels. That is, the smaller end 194 of the teardrop shape 190 forms a diffusion angle 196 downstream of a meter 198. The divergent channels, for example, facilitate maximum coverage cooling of the trailing edge tip corner 130 of the airfoil 92.

Figure 10:
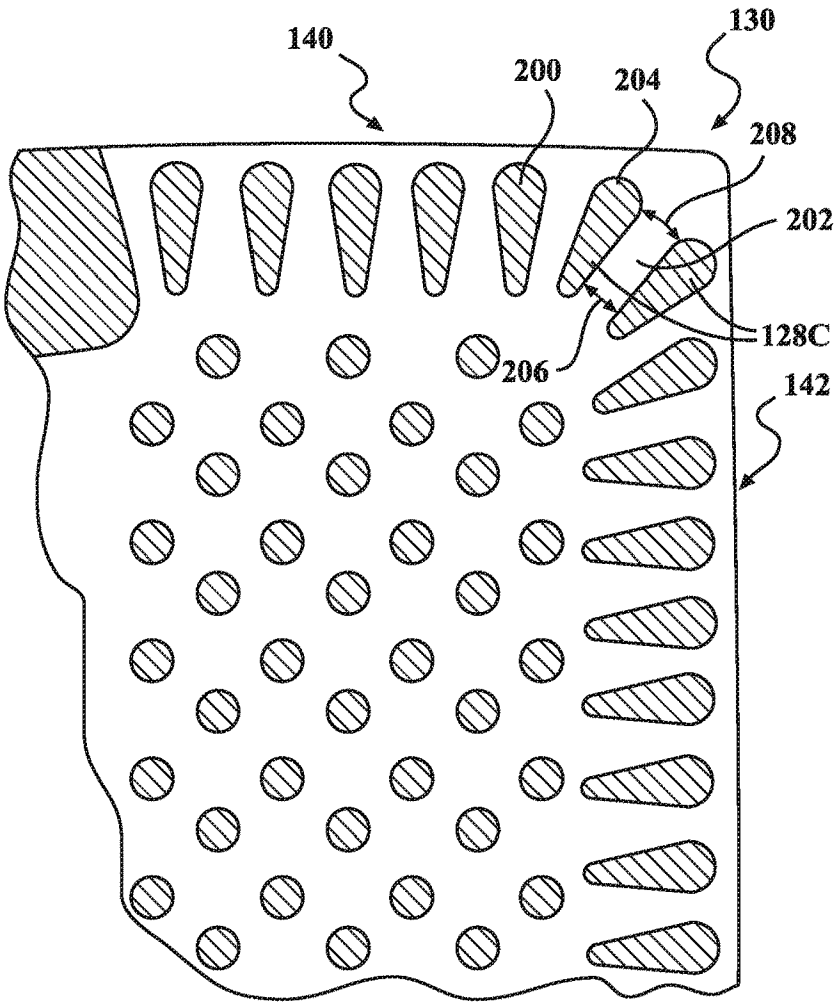
FIG. 10 is an expanded sectional view of a trailing edge cavity with a multiple of corner features according to another disclosed non-limiting embodiment.

With reference to FIG. 10, in another disclosed non-limiting embodiment, the corner features 128C are generally of a teardrop shape 200 to form a multiple of respective corner feature channels 202 therebetween to provide full cooling airflow coverage for the trailing edge tip corner 130 of the airfoil 92. A larger end 204 of the teardrop shape 200 are directed toward the outer tip surface 140 of the tip 96 and the outer trailing edge surface 142 of the trailing edge 100 such that the respective corner feature channels 202 in this disclosed non-limiting embodiment provides convergent channels. That is, the larger end 204 of the teardrop shape 200 forms a convergent angle 206 upstream of a meter 208. The convergent channels, for example, facilitates minimization of mixing losses adjacent to the trailing edge tip corner 130 of the airfoil 92.

Figure 11:
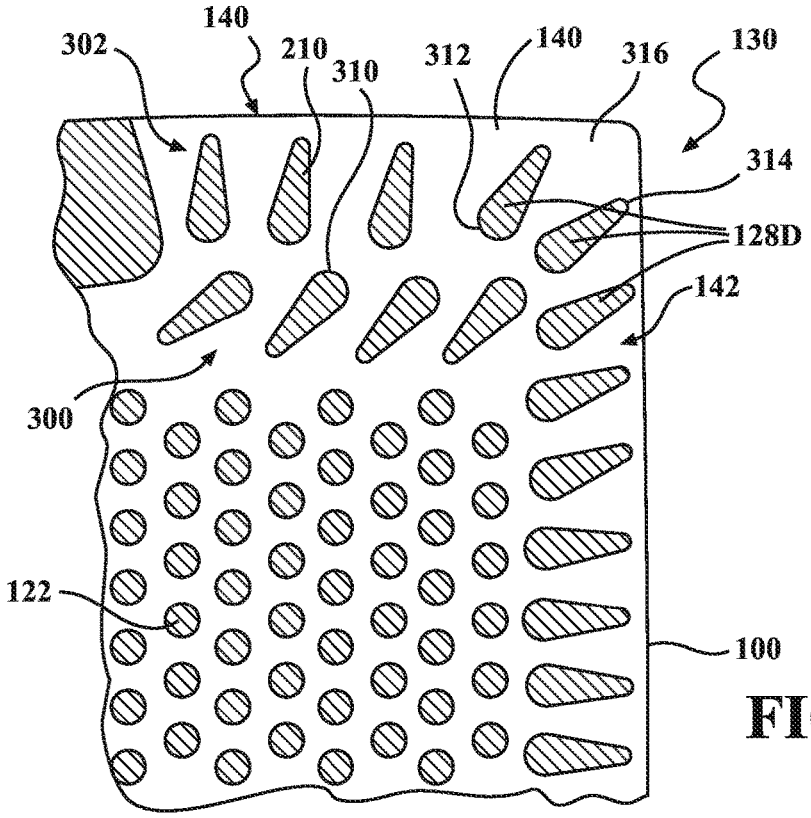
FIG. 11 is an expanded sectional view of a trailing edge cavity with a multiple of corner features according to another disclosed non-limiting embodiment.

With reference to FIG. 11, in another disclosed non-limiting embodiment, the corner features 128D are generally of a teardrop shape. The corner features 128D in this disclosed non-limiting embodiment, includes an inner row 300 of corner features 128D adjacent an outer row 302 of corner features 128D to provide further internal cooling flow guidance. Although the teardrop shape is illustrated in this disclosed non-limiting embodiment, it should be appreciated that various shapes will benefit herefrom. Further, the teardrop shape 210 may be displaced as discussed above to form the trench 180.

A larger end 310 of the inner row 300 of corner features 128D are positioned toward a larger end 312 of outer row 302. That is, each of the corner features 128D of the outer row 302 include smaller ends 314 that are directed toward the outer tip surface 140 of the tip 96 and the outer trailing edge surface 142 of the trailing edge 100 such that the respective corner feature channels 316 provides divergent channels as described above with respect to the FIG. 9 embodiment. The inner row 300 of corner features 128D may be utilized to replace some of the pedestals 122 or otherwise specifically guide the cooling flow.

To facilitate control of a pressure delta between the core flow and the cooling flow through the channels at a desired exit and blade internal pressure, the angle, orientation, size of the meter, and/or the blade internal pressure as well as combinations thereof may varied. That is, the wake or separation caused when the cooling flow through the corner features 128 merges with the gas path flow external to the airfoil 92 may be readily minimized by adjustment of the corner features 128.

Figure 12:
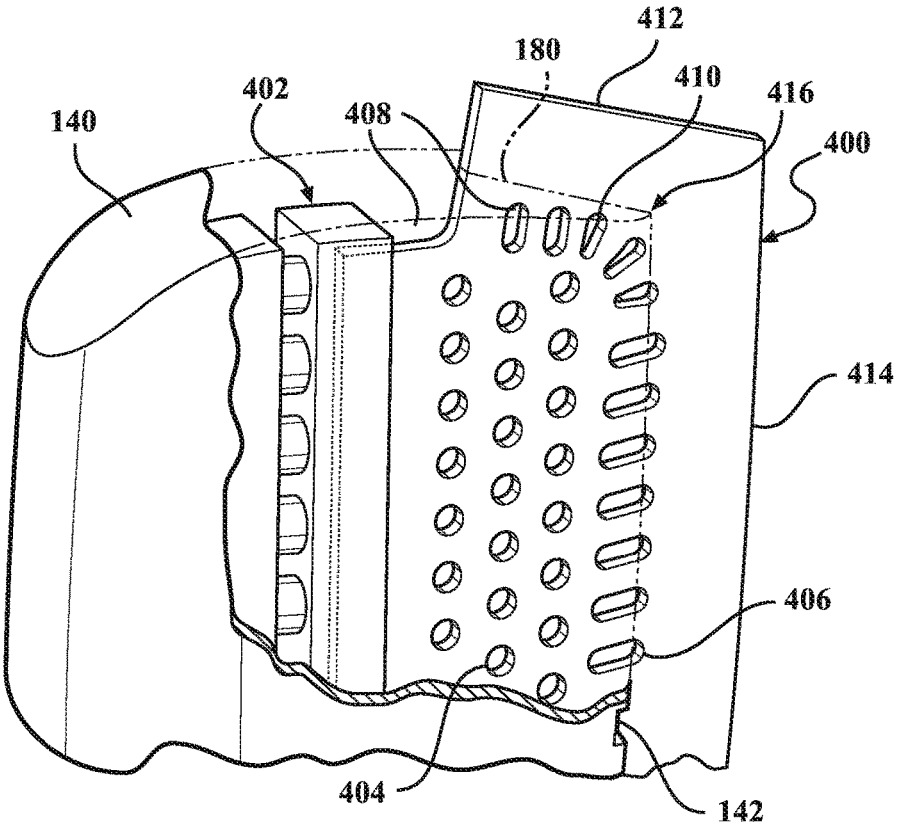
FIG. 12 is a schematic partial fragmentary view of a trailing edge cavity showing an RMC sheet for formation of multiple of corner features according to another disclosed non-limiting embodiment.

With reference to FIG. 12, while not to be limited to any single method, the pedestals 122, the trailing edge features 124, the tip features 126, and the corner features 128 are manufactured with a Refractory Metal Core (RMC) 400. The RMC 400 is mounted to a ceramic core 402 that forms the feed passage 112 (FIG. 6). The RMC 400 in one disclosed non-limiting embodiment is about 10-20 mils (0.254-0.508 mm) thick sheet to form the trailing edge cavity 114.

The RMC 400 includes apertures 404, 406, 408, 410 that form the respective pedestals 122, the trailing edge features 124, the tip features 126, and the corner features 128. The RMC 400 includes an RMC tip edge 412 and an RMC trailing edge 414 that form a corner 416 of the RMC 400. The apertures 404-410 may be of various sizes and shapes such that the blade material that flows therethrough forms the desired trailing edge cavity features that may interconnect the sidewalls 102, 104.

When attached to the ceramic core 402, the RMC tip edge 412 and the RMC trailing edge 414 extend beyond the to be manufactured outer tip surface 140 of the tip 96 and the outer trailing edge surface 142 of the trailing edge 100 such that when the RMC 400 is removed, passages are formed therethrough (FIG. 6). In one disclosed non-limiting embodiment, the apertures 410 that form the corner features 128 are displaced from the wax tip edge and the wax trailing edge by about 10-50 mils (0.254-1.27 mm) to form the trench 180 to accommodate RMC core shift and other tolerances such that the trench 180 in this example is about 20 mils (0.508 mm) deep.

As generally appreciated, the RMC 400 may be attached to the ceramic core 402 such as via an adhesive such that a contiguous flow path is formed between the to be formed feed passage 112 and the trailing edge cavity 114. The RMC 400 and the ceramic core 402 may be removed by, for example, any suitable chemical bath.

Figure 13:
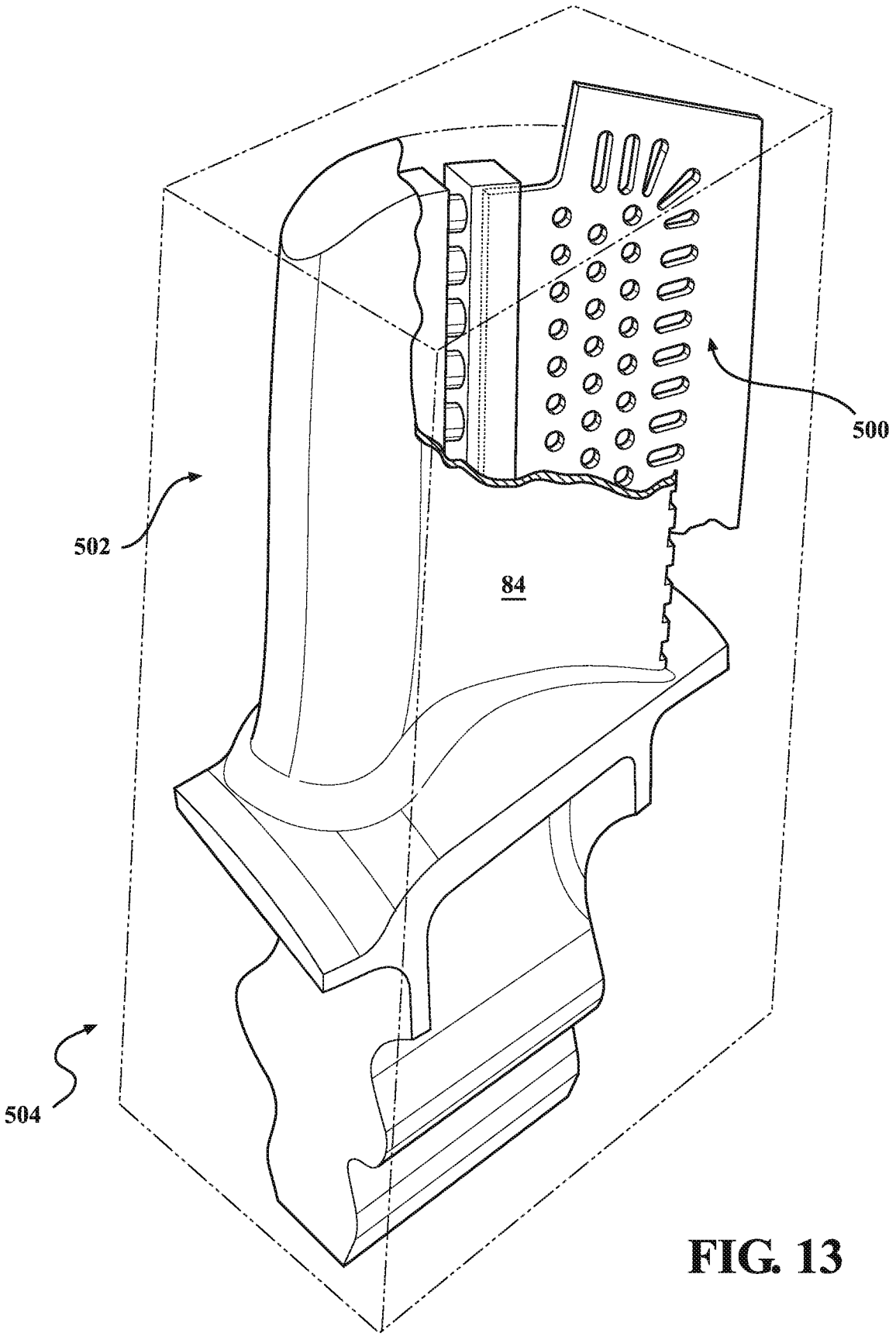
FIG. 13 is a schematic partial fragmentary view of a mold with an RMC sheet and ceramic core within for casting of an airfoil.

The RMC 400 and the ceramic core 402 are assembled to define a core 500 that is positioned within a shell 502 (FIG. 13). The shell 502 defines the outer surface of the blade 84 while the core 500 forms the internal surfaces such as that which defines the array of internal passageways 110 (FIG. 5). That is, during the casting process, the core 500 fills a selected volume within the shell 502 that, when removed from the finished blade casting, defines the array of internal passageways 110 utilized for cooling airflow. The shell 502 and the core 500 define a mold 504 (FIG. 13) to cast complex exterior and interior geometries and may be formed of refractory metals, ceramic, or hybrids thereof. The mold 504 thereby operates as a melting unit and/or a die for a desired material that forms the blade 84. The desired material may include but not be limited to a superalloy or other material such as nickel based superalloy, cobalt based superalloy, iron based superalloy, and mixtures thereof that is melted; a molten superalloy that is then solidified; or other material. In another non-limiting embodiment, the crucible may be filled with a molten supperalloy directly.

Alternatively, or in addition, a single crystal starter seed or grain selector may be utilized to enable a single crystal to form when solidifying the component. The solidification may utilize a chill block in a directional solidification furnace. The directional solidification furnace has a hot zone that may be induction heated and a cold zone separated by an isolation valve. The chill block and may be elevated into the hot zone and filled with molten super alloy. After the pour, or being molten, the chill plate may descend into the cold chamber causing a solid/liquid interface to advance from the partially molten starter seed in the form of a single crystallographic oriented component whose orientation is dictated by the orientation of the starter seed. Casting is typically performed under an inert atmosphere or vacuum to preserve the purity of the casting.

Following solidification, the shell 502 may be broken away and the core 402 may be removed from the solidified component by for example, caustic leaching, to leave the finished single crystal component. After removal, the component may be further finished such as by machining, surface treating, coating or any other desirable finishing operation.

Figure 14:
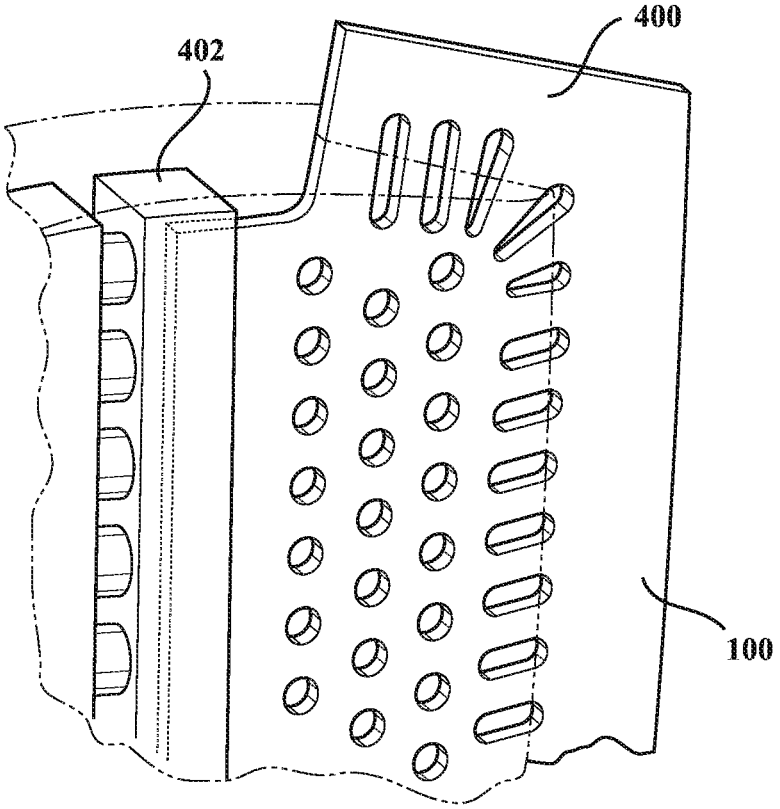
FIG. 14 is an expanded schematic view of an RMC sheet for formation of multiple of corner features according to another disclosed non-limiting embodiment.
Figure 15:
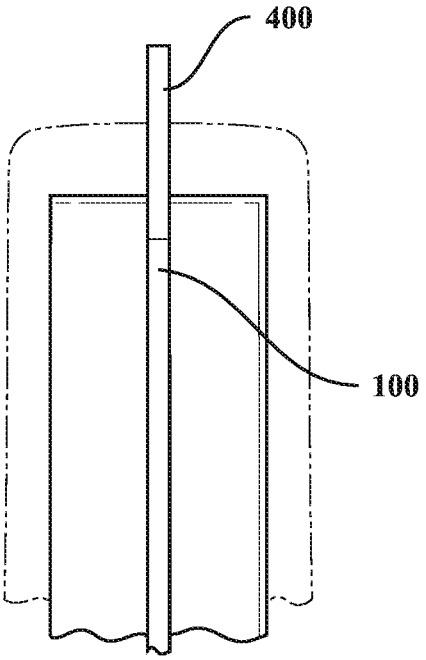
FIG. 15 is a trailing edge view of the RMC sheet of FIG. 14.

With reference to FIG. 14, in another disclosed non-limiting embodiment, the RMC 400 may be curved from the ceramic core 402 to the trailing edge 100 such that the RMC trailing edge 214 of the RMC 400 is in-line with the trailing edge 100 of the blade 84 along the length thereof (FIG. 15). That is, the RMC core 200 essentially exits the outer tip surface 140 of the tip 96 in a straight up manner.

Figure 16:
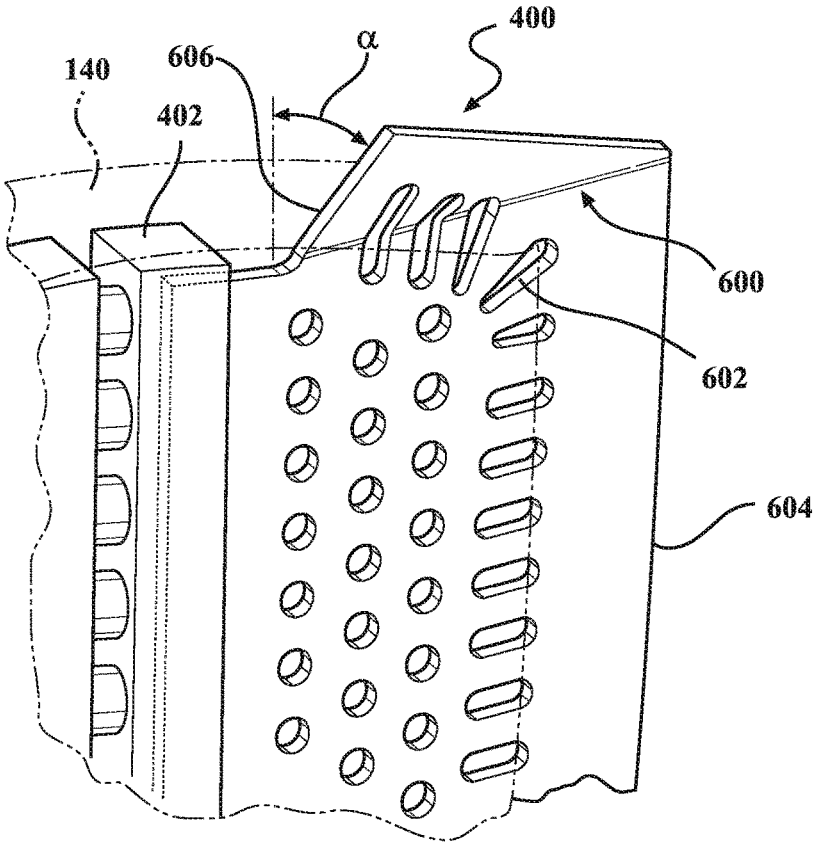
FIG. 16 is an expanded schematic view of an RMC sheet for formation of multiple of corner features according to another disclosed non-limiting embodiment.
Figure 17:
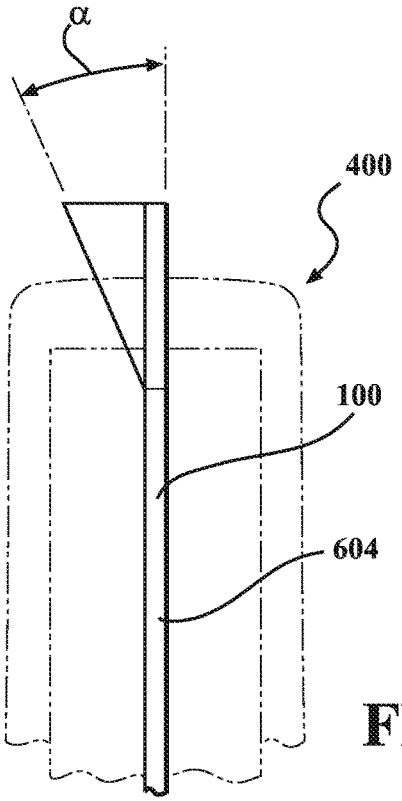
FIG. 17 is a trailing edge view of the RMC sheet of FIG. 16.
Figure 18:
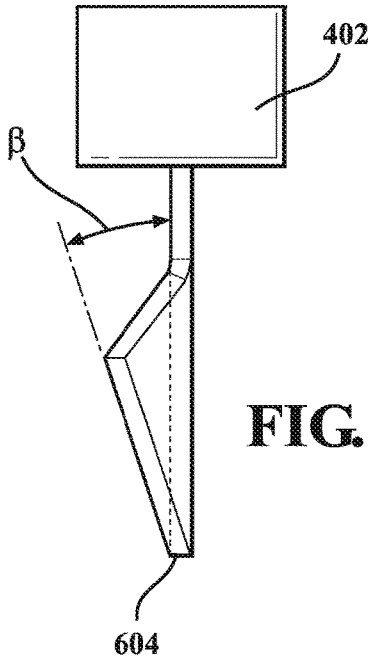
FIG. 18 is a top view of the RMC sheet of FIG. 16.

With reference to FIG. 16, in another disclosed non-limiting embodiment, a bend 600 is positioned within a corner 602 of the RMC 400. The bend 600 arranges the RMC trailing edge 604 of the RMC 400 to be in-line with the trailing edge 100 of the blade 84 but orients a forward portion 606 of the corner 602 of the RMC 400 at an angle with respect to the outer tip surface 140 of the tip 96. The trench 180 thereby is angled to direct the cooling flow against a flow direction of the working gas. In one example, the forward portion 606 of the corner 602 is angled at an angle $\alpha$ of about 10 degrees from a vertical plane that contains the RMC 400 and at an angle $\beta$ of about 15-20 degrees from a plane normal to the RMC 400 (FIGS. 17 and 18).

When the cooling air exits the angled trench 180, the cooling air flows into a tip gap between the outer tip surface 140 of the tip 96 and the BOAS 64 (FIG. 3) due in part to the strong pressure gradient towards the suction side 104 of the airfoil 92. Injecting the cooling air into the tip gap reduces the local temperature of the working gas temperature downstream of the trench 180 thereby further reducing the heat load to the tip region of the blade 84.

The use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to normal operational attitude and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed:

1. A component for a gas turbine engine, comprising:

a tip between a suction side and a pressure side joined at a leading edge and at an axially spaced trailing edge to define a trailing edge cavity bounded by said tip and said trailing edge, a trench within said tip and said suction side and said pressure side meet at said trailing edge;

a trailing edge tip corner of said tip that at least partially defines said trailing edge cavity; and a multiple of corner features within said trailing edge cavity, said multiple of corner features splayed along said trailing edge tip corner, wherein said multiple of corner features define a respective multiple of channels each with an exit, each said exit recessed within said trench, said multiple of corner features comprising at least one teardrop shape that extends transverse to said suction side and said pressure side to direct the cooling flow through said trailing edge cavity, wherein said multiple of corner features are recessed from an outer tip surface and an outer trailing edge surface of said trailing edge tip corner.

2. The component as recited in claim 1, wherein said trailing edge tip corner is defined by a turbine blade.

3. The component as recited in claim 1, wherein a larger end of said at least one teardrop shape faces toward said trailing edge.

4. The component as recited in claim 1, wherein a larger end of said at least one teardrop shape faces toward said trailing edge tip corner.

5. The component as recited in claim 1, wherein a larger end of said at least one teardrop shape faces away from said trailing edge.

6. The component as recited in claim 1, wherein a larger end of said at least one teardrop shape faces away from said trailing edge tip corner.

7. The component as recited in claim 1, wherein said multiple of corner features defines a respective multiple of constant area channels.

8. The component as recited in claim 1, wherein said multiple of corner features defines a respective multiple of divergent channels.

9. The component as recited in claim 1, wherein said multiple of corner features defines a respective multiple of convergent channels.

10. The component as recited in claim 1, wherein said trench is angled to direct a cooling flow against a flow direction of a working gas.

11. The component as recited in claim 1, wherein said multiple of corner features direct the cooling flow at least partially through said trench.

12. The component as recited in claim 1, further comprising a multiple of trailing edge features arranged along said trailing edge.

13. The component as recited in claim 12, wherein said multiple of trailing edge features define trailing edge exits through the trailing edge such that the trailing edge is discontinuous.

* * * * *